US008522925B2

(12) United States Patent
Chevalier et al.

(10) Patent No.: US 8,522,925 B2
(45) Date of Patent: Sep. 3, 2013

(54) DEBRIS FLUSH SYSTEM FOR BALANCE SHAFT BEARINGS

(75) Inventors: Steven J. Chevalier, Britton, MI (US); David E. Tabbert, Brighton, MI (US)

(73) Assignee: Metaldyne Company LLC, Plymouth, MI (US)

( * ) Notice: Subject to any disclaimer, the term of this patent is extended or adjusted under 35 U.S.C. 154(b) by 725 days.

(21) Appl. No.: 11/895,002

(22) Filed: Aug. 22, 2007

(65) Prior Publication Data

US 2008/0053753 A1 Mar. 6, 2008

Related U.S. Application Data

(60) Provisional application No. 60/839,210, filed on Aug. 22, 2006.

(51) Int. Cl.
*F01M 1/00* (2006.01)

(52) U.S. Cl.
USPC ..... 184/6.5; 123/196 R

(58) Field of Classification Search
USPC ..... 184/6.24, 6.5, 6.12; 123/196 R
See application file for complete search history.

(56) References Cited

U.S. PATENT DOCUMENTS

| | | | | |
|---|---|---|---|---|
| 2,439,187 | A | 6/1943 | Roos | |
| 2,544,913 | A | 3/1951 | Brantingham | |
| 3,741,342 | A * | 6/1973 | Maddalozzo | 184/6.4 |
| 3,926,281 | A | 12/1975 | Hannibal | |
| 4,174,927 | A | 11/1979 | Lindstrom | |
| 4,648,363 | A * | 3/1987 | Kronich | 123/196 R |
| 6,234,137 | B1 * | 5/2001 | Spriegel et al. | 123/196 A |
| 6,725,974 | B2 * | 4/2004 | Sato et al. | 184/106 |
| 6,772,725 | B2 | 8/2004 | Inaba et al. | |
| 2002/0144863 | A1 * | 10/2002 | Powell | 184/1.5 |
| 2006/0027198 | A1 * | 2/2006 | Plenzler et al. | 123/90.34 |

FOREIGN PATENT DOCUMENTS

JP 01065393 3/1989

* cited by examiner

*Primary Examiner* — William E Dondero
*Assistant Examiner* — Robert T Reese
(74) *Attorney, Agent, or Firm* — McDonald Hopkins LLC

(57) ABSTRACT

An engine oil filtration system including a pump operable to provide pressurized oil to the system is provided. A filter is in pressurized fluid communication with the pump and an engine lubrication network is in pressurized fluid communication with both the filter and an inlet of a balance shaft module. The balance shaft module also includes an outlet in pressurized fluid communication with the oil pump so that contaminated, pressurized oil may flow from the balance shaft module to the pump and filter for cleaning before being recycled to the engine's lubrication network.

22 Claims, 5 Drawing Sheets

DEBRIS FLUSH SYSTEM FOR BALANCE SHAFT BEARINGS

CROSS-REFERENCE TO RELATED APPLICATION

This non-provisional patent application claims the benefit of U.S. Provisional Patent Application No. 60/839,210, entitled "DEBRIS FLUSH CHANNEL FOR BALANCE SHAFT MODULE," filed Aug. 22, 2006, which is hereby incorporated in its entirety.

FIELD OF THE INVENTION

The present invention relates generally to a fluid filtration system, and more particularly, to an engine oil filtration system for reciprocating internal combustion-type engines having at least one balance shaft.

BACKGROUND

In many internal combustion engines, the engine crankshaft typically drives a balance shaft assembly to reduce engine vibration and noise due to the mass forces associated with the cyclic accelerations of reciprocating pistons and their connecting rods. Balance shafts are required to maintain substantially fixed angular timing relationships with the engine's crankshaft in order to fulfill their force cancellation functionality. And while single balance shafts are sometimes used for such purposes, many engines utilize two balance shafts. Regardless of whether a single balance shaft or multiple balance shafts are utilized, proper and adequate lubrication of the balance shaft bearings is essential in light of the shafts' rotational speed rates and associated centrifugal loadings.

Oil provides lubrication for the balance shaft bearings, as well as the other components of the engine. An oil pump may be driven by, or connected to, one of the balance shafts, the engine's crankshaft, or other drive mechanisms. During operation of the engine, the oil pump operates to provide pressurized oil to the various components of the engine by means of a network of pressurized oil passages. To ensure that clean oil is sent through the system, the oil is typically forced through an oil filter by the oil pump to remove contamination, debris, wear residue, and other foreign substances.

The network of pressurized oil passages within an engine's lubrication system typically extends to include the bearings of its balance shafts when present. If any contamination is resident in the oil passages between the oil filter and the balance shaft bearings when the engine is initially assembled, it will not be filtered out of the oil before reaching the bearings. Such build-phase contamination risks damage to balance shaft bearings, especially hydrostatic-type bearings at the extremities of current art lubrication passage networks where the oil passages terminate, leaving only bearing-to-journal running clearance as escape route for the oil and its possible contaminants to return back to the sump. If the oil contains contaminants larger than can readily escape the very small oil film clearance gap, they will be trapped at the lubrication network terminal bearings, where cyclic motion of the shaft's journal can work them into the clearance gap and produce bearing damage. Damage to balance shaft bearings can lead to engine failure, especially if oil pump functionality is impaired or lost.

Therefore, there exists a significant need for a balance shaft bearing lubrication system capable of readily and efficiently flushing debris and other such contaminants from the balance shaft bearings in order to desensitize the engine system to the risk of failure due to build-phase contamination of its lubrication circuit.

SUMMARY OF THE INVENTION

An embodiment of the present invention provides an engine lubrication system comprising a network of oil passages for the supply of captured pressurized oil to the engine's various key working clearances and components. The system includes a pump operable to provide pressurized oil to a filter in pressurized fluid communication with the engine's lubrication network, also referred to as an engine oil circuit, which includes an oil supply passage, also referred to as a bearing feed circuit, to feed one or more bearings for one or more balance shafts. The balance shaft bearing oil supply passage is in fluid communication with a flush channel, which provides a bypass route downstream of the balance shaft bearing oil supply passage. The flush channel is in pressurized fluid communication with the inlet passage of the oil pump so that contaminated pressurized oil may flow both to and past one or more balance shaft bearings and ultimately back to the pump for subsequent delivery to the filter for cleaning.

The opening of an additional lube passage flow area, such as that constituted by such a flush channel as means of allowing contaminants to bypass terminal balance shaft bearings, acts to lower the flow resistance of the engine's pressurized lubrication network, thus incrementally reducing the pressure available to force oil through the network and its components, particularly at low engine speeds. It is therefore desirable to control the flow resistance of the flush channel, preferably by at least one discharge passage in fluid communication with at least one debris-settling chamber, where larger, heavier debris as may be present in the oil may be accumulated without risk of damage to the oil pump. Alternatively, multiple settling chambers and discharge passages may be arranged in series to provide labyrinth seal-type functionality.

Although the above embodiment provides for the flush channel or channels to flush at least one balance shaft bearings by routing circulating oil and any entrained debris through a series of settling chambers and discharge passages on to the oil pump, it is to be understood that discharge directly to the sump, with or without a settling chamber and/or discharge passage, as well as the flushing of less than all terminal balance shaft bearings, are contemplated herein.

BRIEF DESCRIPTION OF THE SEVERAL VIEWS OF THE DRAWING

Objects and advantages together with the operation of the invention may be better understood by reference to the following detailed description taken in connection with the following illustration, wherein.

DETAILED DESCRIPTION OF THE INVENTION

While the present invention is described with reference to the embodiments described herein, it should be clear that the present invention should not be limited to such embodiments. Therefore, the description of the embodiments herein is illustrative of the present invention and should not limit the scope of the invention as claimed.

Figure 1:
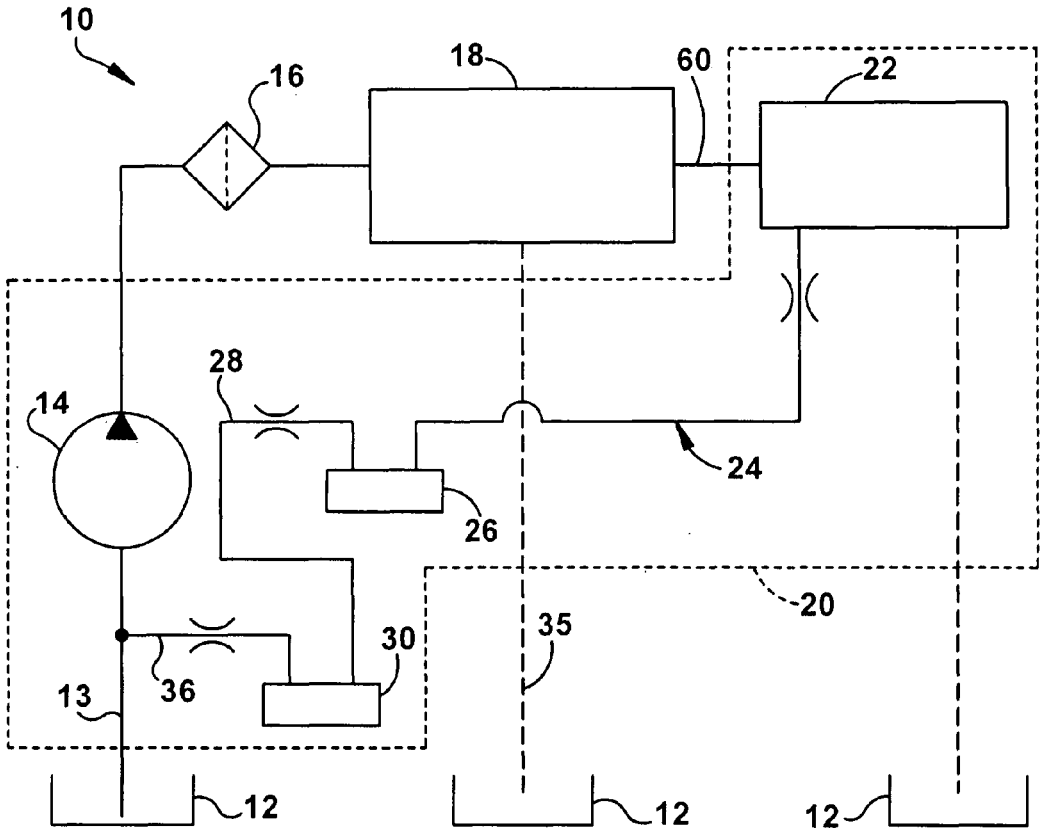
FIG. 1 is a schematic view of one embodiment of an engine oil filtration system.

Reference will now be made in detail to the embodiments of the invention as illustrated in the accompanying figures. Referring now to FIG. 1, a schematic diagram of the oil filtration system 10 is shown. The system 10 may include a dirty oil sump 12 that feeds an oil pump 14. The pump 14 includes a first inlet passage 13 for fluid communication with the sump 12 and is operable to provide pressurized oil to the engine's lubrication network 18 of oil supply passages which includes a balance shaft bearing supply passage 22, also referred to as a bearing feed circuit. Additionally, as illustrated in FIG. 1, the pump 14 may be an integral component of a balance shaft module 20. The pump 14 may pass pressurized oil to an oil filter 16 to remove debris, contaminants and other foreign substances from the oil. The pressurized, filtered oil may then pass to an engine lubrication network 18, also referred to as an engine oil circuit, to lubricate and cool various components of the engine, including but not limited to the cylinders, valve train, etc.

The engine lubrication network 18 is in pressurized fluid communication with the balance shaft module 20, whereby at least a portion of pressurized oil passing through the engine lubrication network 18 passes into the balance shaft module 20 via a balance shaft module inlet 60. Also, as will be readily appreciated by one skilled in the art, a portion of the oil exiting the network 18 may be routed directly back to the dirty oil sump 12, via an engine oil return passage 35, or the like.

Figure 2:
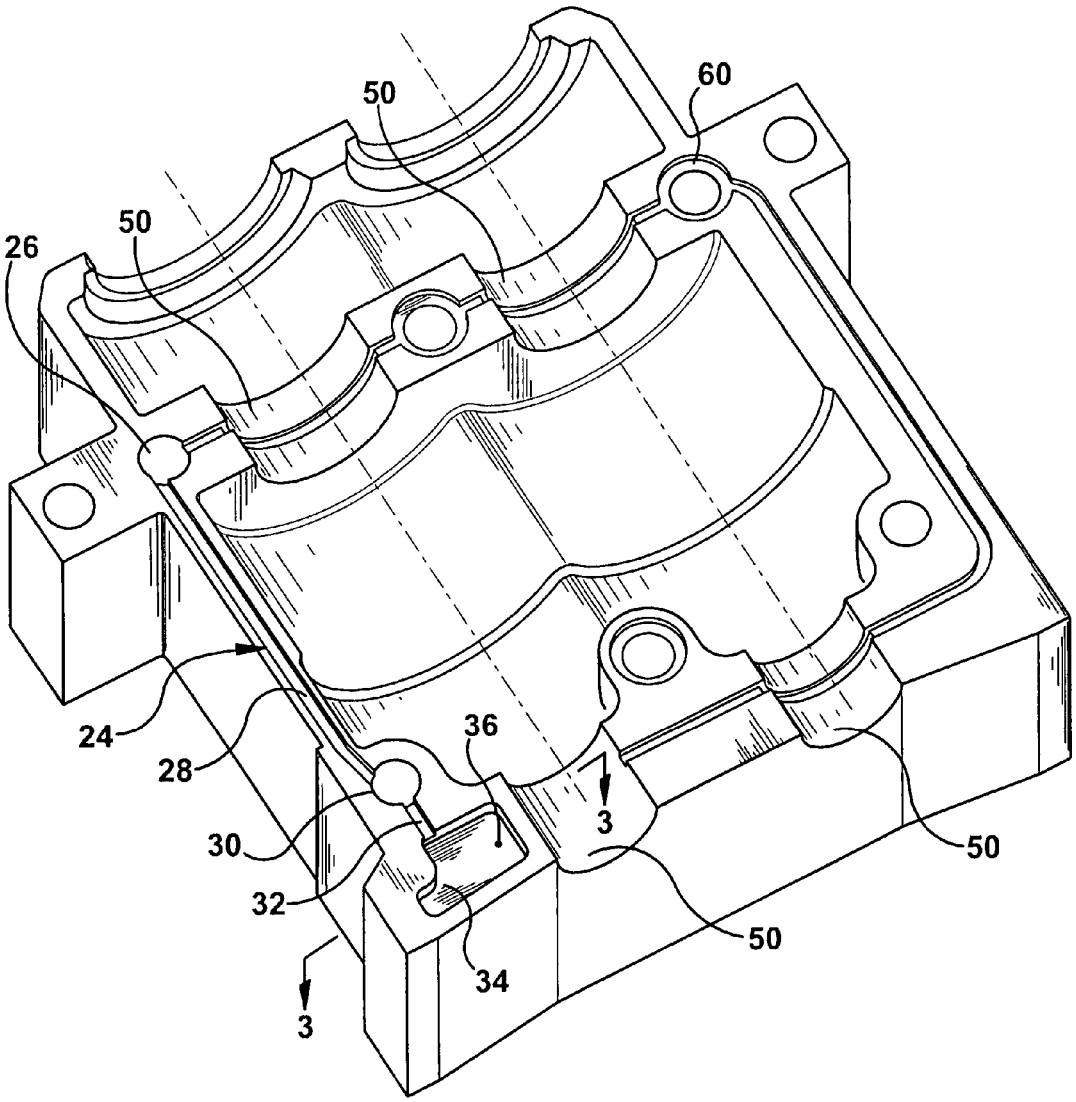
FIG. 2 illustrates a cross-sectional view of a balance shaft module having a bearing oil supply passage and flush channel.

The balance shaft module 20 houses at least one balance shaft for offsetting vibrations generated by an inherently unbalanced engine. As best shown in FIG. 2, in one embodiment the balance shaft module 20 includes at least one bearing surface 50 for supporting a balance shaft. Also, the balance shaft module 20 may include a bearing supply passage 22 in pressurized fluid communication with the module inlet 60. The bearing supply passage 22 may route pressurized oil from the module inlet 60 to each bearing surface 50 so as to provide lubrication between the balance shaft and corresponding bearing surfaces 50.

As further shown in FIG. 2, the supply passage 22 may extend through one or more bearing surfaces 50 to a flush channel 24. The supply passage 22 and flush channel 24 are in pressurized fluid communication whereby debris, contaminants and other foreign substances collected in the oil may be routed past the bearing surfaces 50 to the flush channel 24. In this arrangement, the bearing surfaces 50 of the balance shaft module 20 are fed with pressurized oil such that they are less susceptible to damage from contaminants in the oil because the contaminants are flushed away therefrom. Further, the flow rate of the pressurized oil also serves to cool the bearing surfaces 50 more uniformly, thereby extending the life of the bearings. Therefore, the bearing surfaces 50 are less likely to retain a substantial amount of debris and other contaminants from the oil, thus resulting in a substantially decreased risk of bearing damage during operation.

The flush channel 24 may have any suitable configuration to provide an engineered flow resistance capable of producing an upstream, contaminant-mobilizing flow rate in oil passing through the bearing surfaces 50 such that the oil passing through the bearings 50 is maintained at sufficient pressure while also passing through the bearings 50 at a sufficient rate to effectively carry debris and other contaminants past and/or remove debris and other contaminants from the bearings 50 under all engine operating conditions. For example, the flush channel 24 may include a one or more debris settling chambers 26, 30, and 34 in series fluid communication with one another via one or more discharge passages 28 and 32 extending therebetween. Each of the chambers 26, 30 and 34 and/or discharge passages 28 and 32 may have any suitable cross-sectional area, cross-sectional shape, length, finish or any other suitable feature or construction to produce the desired upstream, contaminant-mobilizing flow rate. Other methods and techniques as applied to the flush channel 24 to achieve the desired upstream flow rate and oil pressure at the bearings 50 will be readily apparent to one skilled in the art. In addition and advantageously, the debris settling chambers 26, 30, and 34 may also serve to accumulate, and thus remove, larger and heavier debris from bypassing oil. Also, it will be appreciated that the forgoing description and depiction of a series of settling chambers is illustrative only, with either fewer or more of such chambers being capable of providing similar flow resistance and debris accumulation. Additionally, as best shown in FIG. 3, the second and third settling chambers 30 and 34, may be cast as an integral portion of the module 20 to avoid unnecessary manufacturing costs.

Figure 3:
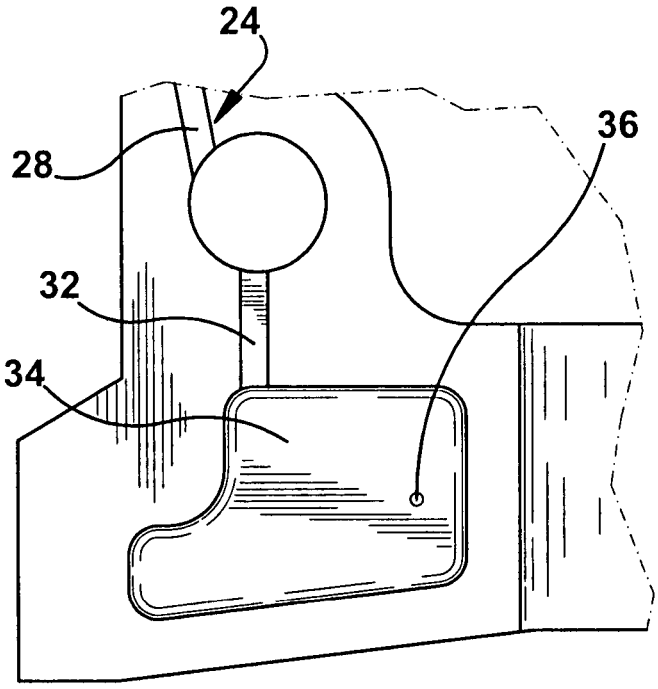
FIG. 3 illustrates an enlarged partial view of the cross-sectional view of FIG. 2 showing the flush channel with a series of debris-settling chambers in communication with discharge passages and leading to the oil pump inlet.

Referring now to FIGS. 2 and 3, the flush channel 24 is also in pressurized fluid communication with an inlet 13 of the pump 14 via a balance shaft module outlet 36 such that contaminated oil may pass from the balance shaft module 20 to the pump 14 and ultimately be passed through the oil filter 16 for cleaning before being passed on through the system 10 again. Similar to the aforementioned chambers 26, 30 and 34 and discharge passages 28 and 32, the module outlet 36 may be configured to assist the flush channel 24 in providing the aforementioned-engineered flow resistance within the module 20.

Figure 4:
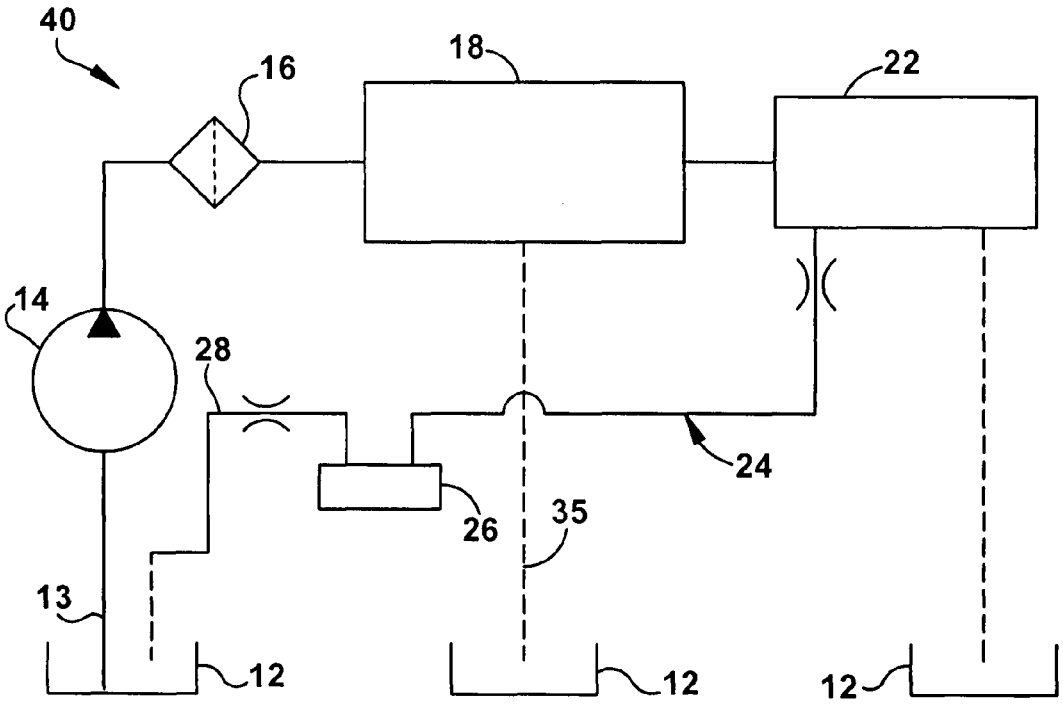
FIG. 4 is a schematic view of a second embodiment of an engine oil lubrication system.

Referring now to FIG. 4, an alternative embodiment of an engine oil lubrication system 40 is shown. This system 40 is similar to that shown in FIG. 1 except the flush channel 24, comprising a single settling chamber 26 and passage 28, discharges into the sump.

Figure 5:
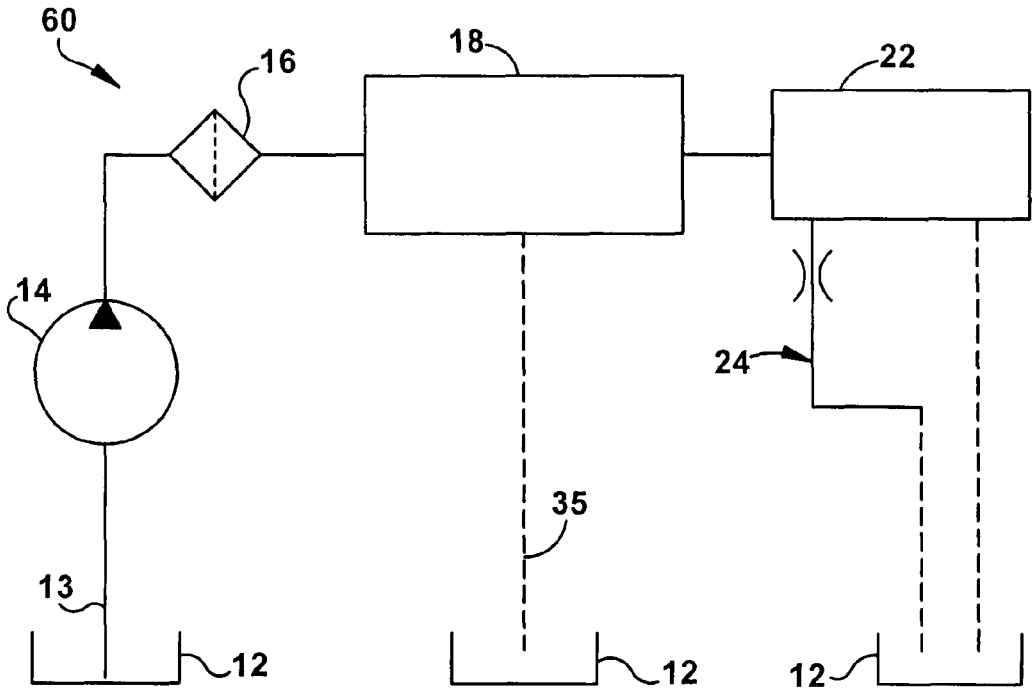
FIG. 5 is a schematic view of a third embodiment of an engine oil lubrication system.

FIG. 5 illustrates yet another embodiment of an engine oil lubrication system 60. This system 60 is similar to that shown in FIG. 4 except the flush channel 24 discharges into the sump without employing a settling chamber. Here, the flush channel 24 has any suitable cross-sectional area and length to produce the appropriate flow resistance to allow the desired flow rate through the bearings 50.

While the invention has been described with reference to the preferred embodiment, other embodiments, modifications, and alternations may occur to one skilled in the art upon reading and understanding of this specification and are to be covered to the extent that they fall within the scope of the appended claims. Indeed, the invention as described by the claims is broader than and not limited by the preferred embodiment, and the terms in the claims have their full and ordinary meaning.

Having thus described the invention, we claim:

1. An engine oil filtration system comprising:

a pump operable to provide pressurized oil to the system;

a filter in pressurized fluid communication with said pump;

an engine circuit in pressurized fluid communication with said filter; and a balance shaft module with at least one bearing surface having:

an inlet in pressurized fluid communication with said engine circuit;

a bearing feed circuit in pressurized fluid communication with said inlet;

a flush channel in direct pressurized fluid communication with said bearing feed circuit, said flush channel including at least one settlement chamber; and an outlet in pressurized fluid communication with said pump so that contaminated pressurized oil may flow from said balance shaft module to said pump.

2. The engine oil filtration system of claim 1 further comprising an oil sump wherein said sump is in fluid communication with said pump.

3. The engine oil filtration system of claim 2 wherein said oil sump is a dry oil sump.

4. The engine oil filtration system of claim 2 wherein said oil sump is a wet oil sump.

5. The engine oil filtration system of claim 2 wherein said pump comprises a first inlet in fluid communication with said oil sump and a second inlet in pressurized fluid communication with said balance shaft module outlet.

6. The balance shaft module of claim 2, further comprising an oil return passage extending from said bearing shaft module and in fluid communication with said oil sump.

7. The engine oil filtration system of claim 1 wherein said balance shaft module further comprises a channel for providing pressurized fluid communication between said module inlet and said module outlet.

8. The engine oil filtration system of claim 7 wherein said balance shaft module further comprises a bearing surface for rotatably supporting a balance shaft wherein at least a portion of said channel is disposed in said bearing surface.

9. The engine oil filtration system of claim 1 wherein said pump is integral with said balance shaft module.

10. An engine oil filtration system comprising:

a pump having an inlet and an outlet, said pump operable to provide pressurized oil to the system;

a filter in pressurized fluid communication with said pump outlet to remove debris or contaminants from the oil;

an engine circuit in pressurized fluid communication with said filter, said engine circuit utilizing pressurized oil to lubricate, cool, and flush debris from engine components; and a balance shaft module having at least one bearing surface, said balance shaft module comprising:

an inlet in pressurized fluid communication with said engine circuit;

a bearing feed circuit in pressurized fluid communication with said balance shaft module inlet;

a flush channel in direct pressurized fluid communication with said bearing feed circuit and including at least one settlement chamber for collecting debris therein; and an outlet for providing pressurized fluid communication between said flush channel and said pump inlet so that contaminated oil may flow from said balance shaft module to said pump.

11. The engine oil filtration system of claim 10 further comprising an oil sump wherein said sump is in fluid communication with said pump.

12. The engine oil filtration system of claim 11 wherein said oil sump is a dry oil sump.

13. The engine oil filtration system of claim 11 wherein said oil sump is a wet oil sump.

14. The engine oil filtration system of claim 11 wherein said pump comprises a second inlet in fluid communication with said oil sump.

15. The balance shaft module of claim 11, further comprising an oil return passage extending from said bearing shaft module and in fluid communication with said oil sump.

16. The engine oil filtration system of claim 10 wherein said bearing surface is configured for rotatably supporting a balance shaft.

17. The engine oil filtration system of claim 16 wherein at least a portion of said bearing feed circuit is disposed in said bearing surface.

18. The engine oil filtration system of claim 10 wherein said pump is integral with said balance shaft module.

19. A balance shaft module for use with an engine oil filtration system comprising:

an inlet capable of pressurized fluid communication with an engine circuit;

a bearing surface for rotatably supporting at least one balance shaft;

a bearing feed circuit capable of pressurized fluid communication with said inlet;

a flush channel in direct pressurized fluid communication with said bearing feed circuit and including at least one settlement chamber; and an outlet capable of pressurized fluid communication with said flush channel and capable of pressurized fluid communication with an oil pump so that contaminated oil may flow from said balance shaft module to the oil pump.

20. The balance shaft module of claim 19 wherein at least a portion of said bearing feed circuit is disposed in said bearing surface.

21. The balance shaft module of claim 20 having a plurality of bearing surface for rotatably supporting a pair of balance shafts rotating in opposite directions.

22. The balance shaft module of claim 19, further comprising an oil sump and an oil return passage extending from said bearing shaft module and in fluid communication with said sump.

* * * * *